US005265342A

United States Patent [19]

Lang, Jr.

[11] Patent Number: 5,265,342

[45] Date of Patent: Nov. 30, 1993

[54] DRYWALL CUTTING TOOL

[76] Inventor: Joseph D. Lang, Jr., P.O. Box 282, Falls City, Tex. 78113

[21] Appl. No.: 968,304

[22] Filed: Oct. 29, 1992

[51] Int. Cl.[5] ..... B26B 29/00

[52] U.S. Cl. ..... 30/294; 30/290; 30/293

[58] Field of Search ..... 30/289, 290, 293, 294, 30/296; 33/32.2, 42, 526, 527, 812

[56] References Cited

U.S. PATENT DOCUMENTS

| | | | |
|---|---|---|---|
| 2,952,025 | 9/1960 | Johnson . | |
| 3,286,351 | 11/1966 | McAlister . | |
| 4,030,195 | 6/1977 | Insolio | 33/32.2 |
| 4,799,315 | 1/1989 | Ziegler | 30/293 |
| 4,825,549 | 5/1989 | Huang | 30/293 |
| 4,903,409 | 2/1990 | Kaplan et al. . | |
| 4,949,462 | 8/1990 | Spencer . | |
| 5,038,483 | 8/1991 | Witek | 33/42 |
| 5,048,189 | 9/1991 | Aurness et al. | 30/293 |
| 5,083,375 | 1/1992 | Helm, Sr. . | |
| 5,153,998 | 10/1992 | Duncan | 30/290 |

*Primary Examiner*—Douglas D. Watts
*Assistant Examiner*—Paul M. Heyrana, Sr.
*Attorney, Agent, or Firm*—Richard C. Litman

[57] ABSTRACT

A drywall measuring and cutting tool has a guide riding the edge of a sheet of drywall and, normal thereto, a graduated rod. A knife is fastened to the rod, and can be rotated for shallow or deep cuts. The guide has an opening through which passes the graduated rod. Idle rod length thus projects away from the knife, avoiding interference with the floor of a drywall truck when cutting drywall carried by the truck. When making repeated narrow scores, measurement and addition of numbers possibly including fractions are avoided by aligning graduation marks with score lines. Adjusting for new width cuts is performed without tools. The knife is adjustable for right or left hand operation.

11 Claims, 4 Drawing Sheets

FIG. 8 B
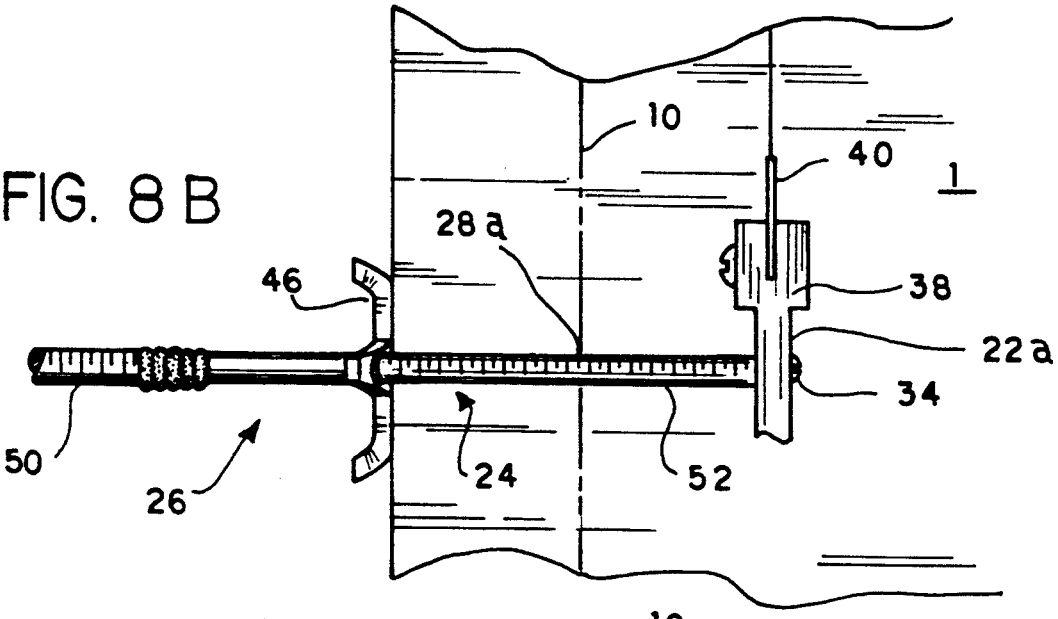
FIG. 8A
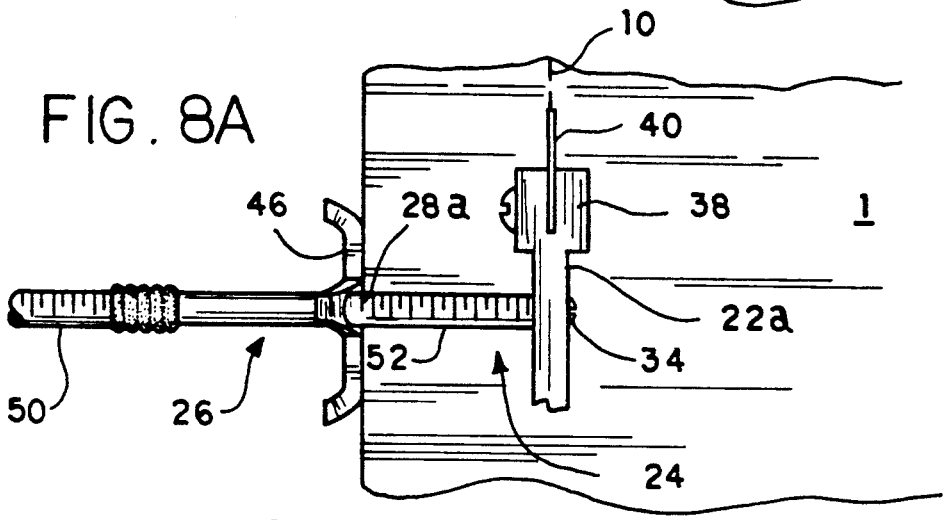
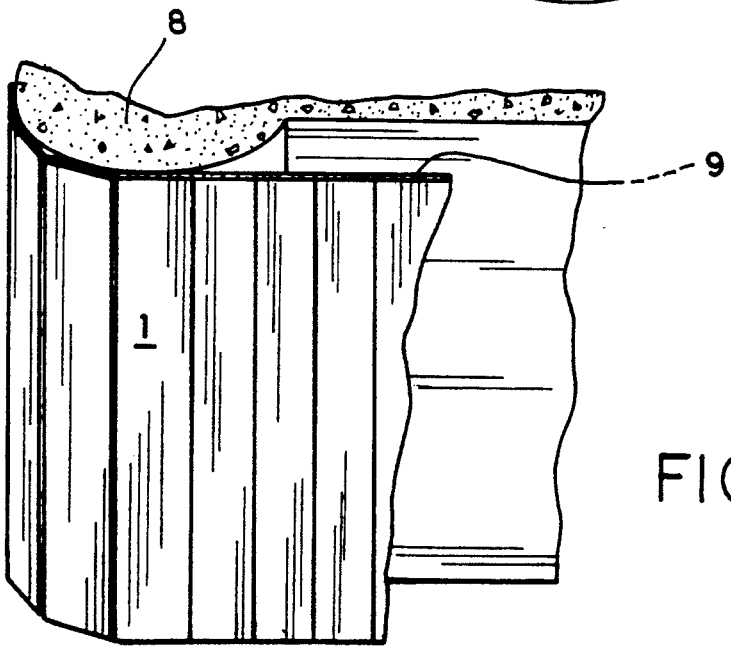
FIG. 9

DRYWALL CUTTING TOOL

BACKGROUND OF THE INVENTION

1. Field of the Invention

The present invention relates to a tool for measuring, cutting and scoring stock planar material, such as drywall.

2. Description of the Prior Art

The prior art has long attempted to provide a practical tool to cut or score a measured width of drywall or the like, typically employing apparatus intended to be secured to pre-existing tools such as T-squares and tape measures. The following U.S. Pat. Nos. are exemplary of prior art tools: 2,952,025, issued to F. H. Johnson on Sep. 13, 1960; 3,286,351, issued to R. McAlister on Nov. 22, 1966; 4,903,409, issued to S. N. Kaplan et al. on Feb. 27, 1990; 4,949,462, issued to M. P. Spencer on Aug. 21, 1990; and 5,093,375, issued to L. Helm, Sr. on Jan. 28, 1992.

In the prior art, a tee is defined including a guide having a planar surface by which the tool is trued to the sheet of material being cut, and, normal to the planar surface, a member defining a longitudinal axis along which a knife is moved to provide adjustment. The longitudinal member will hereinafter be referred to as the stem. The stem typically bears graduated indicia enabling measurement and appropriate adjustment of the cutting member. In all examples of the prior art known to the applicant, position of the cutting element is adjusted by moving the knife along the stem, the guide being integrally fixed to the stem.

Although this arrangement enables measuring and cutting tools to be readily formed by the simple expedient of mounting a knife slidably to a T-square or similar apparatus, limitations result to the practical use of a tool so formed.

These limitations, and the improvement overcoming these limitations, will be further described hereinafter. None of the above inventions and patents, taken either singly or in combination, is seen to describe the instant invention as claimed.

SUMMARY OF THE INVENTION

The present scoring and cutting tool is configured as a tee, the top of the tee forming a guide riding on an edge of planar material to be cut (preferably a sheet of drywall) and the stem bearing measurement indicia, and a knife attached to the tool and being adjustable with respect to the guide. The novel tool differs from the prior art in combining a graduated stem and a knife in a single, rigid part. The guide forms a second part, and is adjustably positioned on the stem so that a portion of the stem being actively used to measure and support the knife extends to one side of the guide, and an idle portion of the stem extends to the other side of the guide. When in use, the adjustable guide is clamped to the stem to form a unified, rigid assembly.

The guide clamps to the stem in the deployed position by applying hand pressure, which binds the guide to the stem by friction. When hand pressure is removed and the guide no longer binds, the guide is tilted and slides axially along the stem, as for repositioning the guide when setting up the tool for a new cut to a different dimension. The knife is removably attached, as by a screw, to the stem. The knife is therefore removable for service or for repositioning for opposite hand operation. The stem and knife assembly is rotated to adjust the depth of blade penetration of the material being scored or cut.

Graduations are arranged to start at the knife, and extend toward the guide. In the prior art, the direction of graduation is generally opposite.

The novel tool thus avoids measurement and addition operations when scoring, but not cutting, a series of horizontal segments in a sheet of drywall. The tool also avoids interference between the stem and the floor of a cart or the like used to carry drywall when a series of horizontal cuts is required. Both characteristics of the novel tool are further explained hereinafter.

Accordingly, it is a principal object of the invention to provide a drywall cutting tool wherein the stem is adjustable relative to the guide.

A second object of the invention is to provide a drywall cutting tool wherein idle stem length projects away from the knife.

It is another object of the invention to provide a drywall cutting tool wherein adjustment for cutting a different dimension does not require tools to secure the drywall cutting tool parts in place.

It is a further object of the invention to provide a drywall cutting tool wherein the knife is removable by a hand tool.

Still another object of the invention is to provide a drywall cutting tool which is adjustable for right or left hand operation.

Yet another object of the invention is to provide a drywall cutting tool enabling selective shallow and deep cuts.

It is still a further object of the invention to provide a drywall cutting tool having graduated measurement indicia commencing at the knife and progressing in the direction of the guide.

An additional object of the invention is to provide a drywall cutting tool comprising at most one fixed and one moving part during adjustment for cutting or scoring to a new width.

Still an additional object of the invention is to provide a drywall cutting tool comprising one fixed part during cutting and scoring operations.

Yet an additional object of the invention is to provide a drywall cutting tool which is readily grasped and operated by hand.

Still another object of the invention is to provide a drywall cutting tool having a knife comprising a single part having an integral blade.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 8A is a top plan view of the novel tool.

FIG. 8B is a top plan view of the novel tool corresponding to FIG. 8A, but showing adjustment for a second cut or score of equal width, prior to the first cut piece being removed.

FIG. 9 is a perspective detail view showing installation of drywall on a curved surface.

Similar reference characters denote corresponding features consistently throughout the attached drawings.

DETAILED DESCRIPTION OF THE PREFERRED EMBODIMENTS

Figure 1:
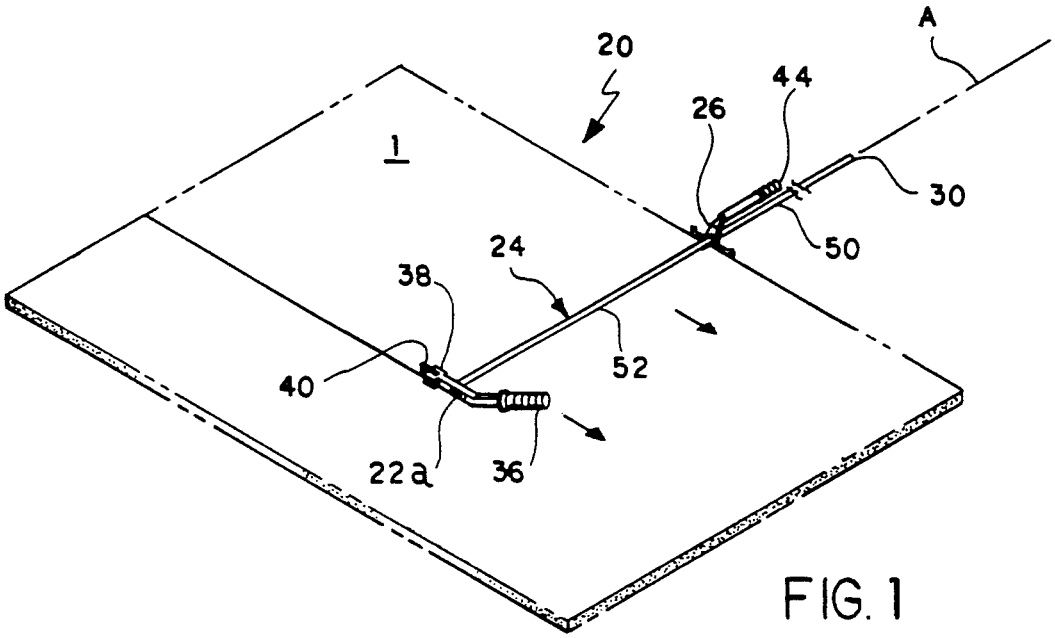
FIG. 1 is a perspective, environmental view of the invention.

The present invention 20 is seen in FIG. 1 in its environment, a cutting or scoring pass being performed on a sheet of planar material such as drywall 1 being shown in progress. The novel tool 20 provides a knife 22A secured at an end of a longitudinal member, or stem 24, which defines a longitudinal axis A, thus forming a first part of the novel tool. A second tool part comprises a guide 26 which is adjustably positioned on the stem 24. Graduated measurement indicia 28 are provided on the stem 24 in the form of an ascending scale commencing with a zero value at the knife 22A, and progressing as the indicia 28 extend toward the guide end 30 of the stem 24. Preferably, the indicia 28 comprise grooves 32 (see FIG. 2), which will resist being rendered illegible by wear.

Figure 4:
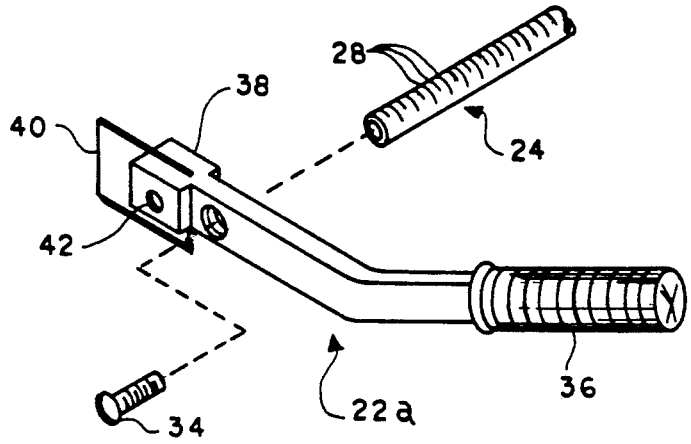
FIG. 4 is a perspective detail view of the knife of a first embodiment of the invention.
Figure 5:
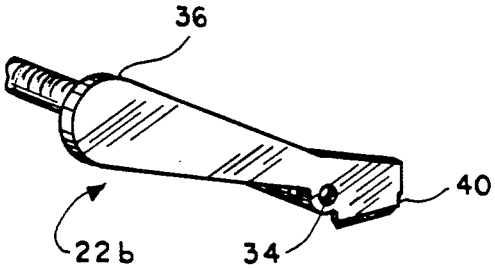
FIG. 5 is a perspective detail view of the knife of a second embodiment of the invention.

Best seen in FIG. 4, the knife 22A is removably attached to the stem 24 as by a screw 34. The knife 22A has a handle 36 and a blade holding member 38 to retain a replaceable blade 40, as by a screw 42. In a second embodiment, as shown in FIG. 5, a single part knife 22B is provided. This knife 22B is removable for sharpening, but no replacement blade element need be furnished.

Figure 3:
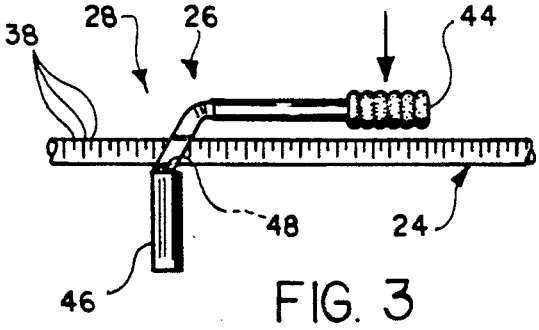
FIG. 3 is a side elevational detail view of the guide in its deployed position.
Figure 6:
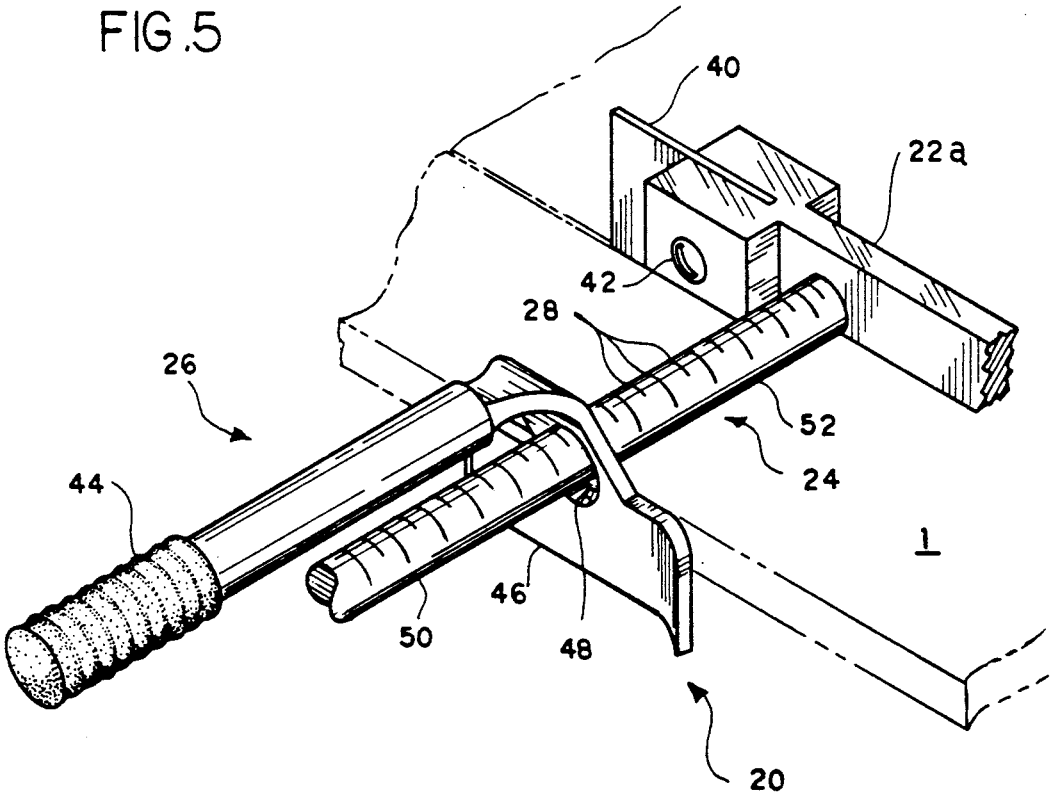
FIG. 6 is a perspective detail view of the invention, drawn to enlarged scale.

Turning to FIG. 6, the guide 26 is seen to comprise a handle 44 and a member 46 presenting a planar surface normal to the tool longitudinal axis A. Stem 24 is inserted into an opening 48 located in the guide 26. This opening 48 is of diameter just greater than the diameter of stem 24. Downward pressure, indicated by an arrow in FIG. 3, causes the guide 26 to bind against stem 24, the guide 26 and stem 24 being locked together in a deployed position.

The cutting tool 20 is grasped with one hand on the guide handle 44 and one hand on the knife handle 36. The cutting tool 20 is then pulled across the material 1, with suitable pressure urging the blade 40 to penetrate the material 1, there also being suitable pressure locking the guide 26 to the stem 24.

Figure 2:
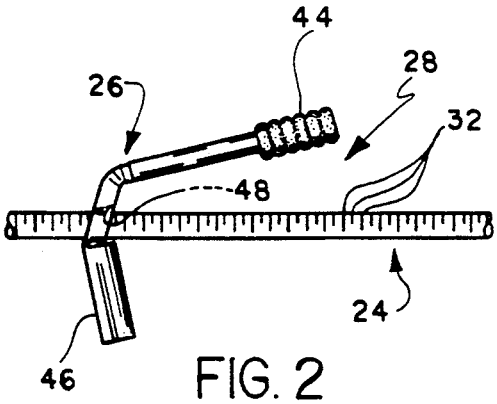
FIG. 2 is a side elevational detail view of the guide in position ready for adjustment for a new cutting dimension.

The guide 26 is repositioned along the stem 24 to accommodate cutting or scoring to a new dimension. The guide handle 44 is tilted upwardly, as seen in FIG. 2, thus moving out of a deployed position, and the guide 26 is now moved axially along the stem 24.

The guide 26 is then moved to a desired new location on the stem 24. The stem 24 is at all times surrounded by the guide member 46, thus captively retaining the guide 26. This prevents annoying unintended disengagement of the guide 26 with the stem 24.

The novel tool 20 is thus seen to be entirely hand operated during cutting and scoring operation. Disassembly of the knife 22A or 22B, as for service to the blade 40 or for adjustment for opposite hand operation, is performed with a common screwdriver (not shown).

Two important benefits accrue from the novel arrangement wherein the guide 26 is adjustably mounted on the stem 24 (instead of the knife 22A or 22B being so mounted), and wherein the measurement indicia 28 is oriented opposite traditional practice. The construction industry traditionally handles drywall 1 on trucks 2, illustrated in FIG. 7B, dedicated to this purpose. The truck 2 carries the drywall 1 from one or more central supply locations on a construction site to the point of installation, and must be sufficiently narrow to negotiate typical doorways. This narrowness necessitates loading drywall 1 onto the trucks 2 in an upright position. The truck 2 further serves as a support when the drywall 1 is cut to fit, immediately prior to installation. If the drywall 1 were moved temporarily onto a work bench or the like for cutting, an extra step requiring labor would be added to the handling of the drywall 1. Concurrently, there is the possibility of damage to drywall 1 whenever it is set down on edge, or handled in any way. Hence, the truck 2 serves as transport means and as a workbench.

Figure 7A:
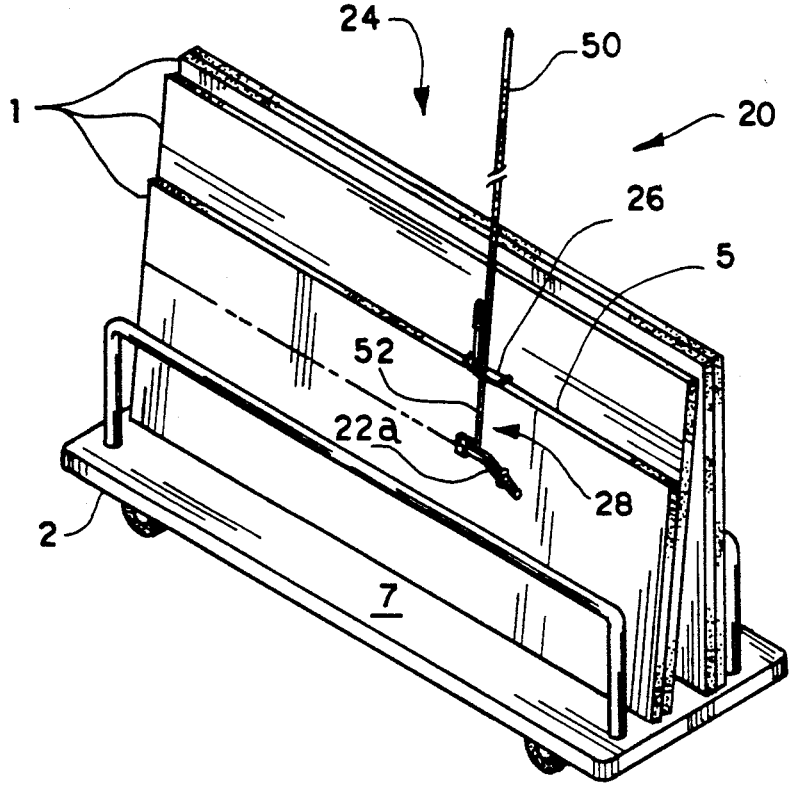
FIG. 7A is a perspective environmental view of the tool as used cutting drywall loaded on a drywall truck.
Figure 7B:
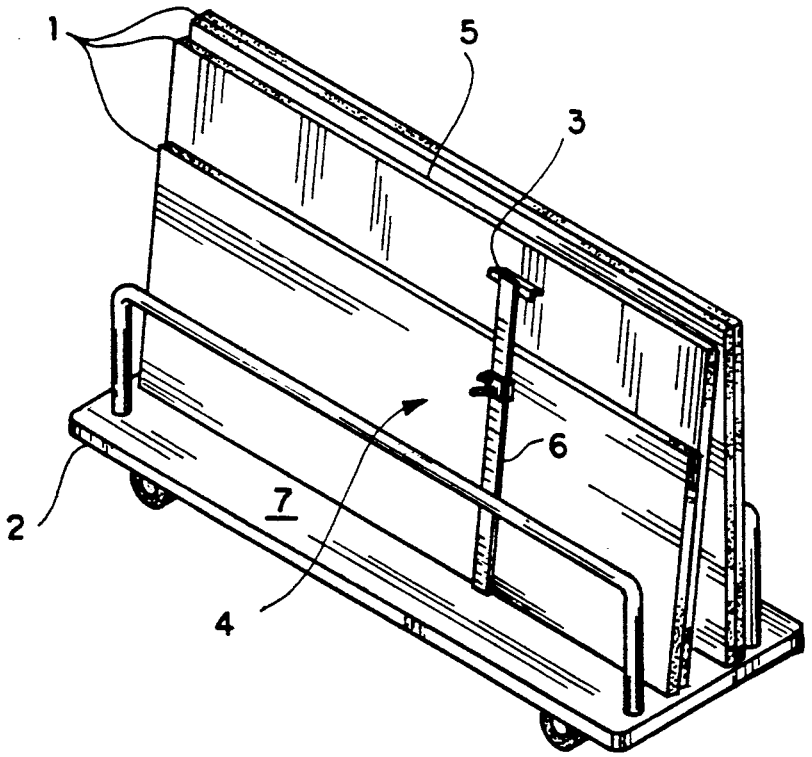
FIG. 7B PRIOR ART
FIG. 7B is a perspective environmental view corresponding to FIG. 7A of a prior art tool as used to cut drywall loaded on a drywall truck.

The first problem arises where drywall 1 is to be cut into many narrow strips. As an example, this may occur in building an apartment building or motel, where many similar windows must be cased. The guide 3 of a prior art cutting tool 4 is placed on the upward edge 5 of a drywall sheet 1 (if placed on the bottom, the tool 4 and the truck 2 would interfere). As successive strips are cut and removed, the stem 6 of a prior art cutting tool 4, shown in FIG. 7B, reaches a point of interfering with the truck platform 7 as the guide 3 is progressively positioned on each freshly cut edge 5. As seen in FIG. 7B, the guide 3 of the prior art cutting tool 4 cannot be lowered to rest on the upward edge 5 of the drywall 1. The ability to cut the drywall 1 in place on the truck 2 is thus lost for the last few passes.

The novel tool 20 solves this problem because an idle portion 50 of the stem 24 projects through the guide 26, and away from the knife 22A or 22B; only an active portion 52 of the stem 24 (that portion of the stem 24 actually being employed to measure drywall 1 and support the knife 22A or 22B at a required distance from the guide 26) extends downwardly. This distance, plus thickness of knife 22A or 22B, determines the lowest projection of the cutting tool 20 below the drywall upward edge 5, when the cutting tool 20 is used in the orientation described above. Referring to FIG. 7A, it will be seen, therefore, that no idle portion 50 of stem 24 is present to interfere with either the truck platform 7 nor with the floor (not shown).

A related aspect of the ability of the cutting tool 20 to avoid interference between the knife 22A or 22B and the guide 26 is the ability to be adjusted to cut very narrow strips from drywall 1, such as strips less than one inch in width. This ability is seldom found in prior art devices.

A second problem encountered in the prior art arises when several narrow strips of drywall 1 are to be scored, but not cut. An example of this occurs where a partition or wall 8 having a curved form is to be covered by drywall 1. Seen in FIG. 9, it is desirable to lay a sheet of drywall 1 having several parallel segments scored, but not cut, against the curved partition or wall 8. Each succeeding segment of drywall 1 assumes an angle corresponding to its respective part of the curved partition or wall 8, but remains united to the other segments by an uncut paper backing 9. To accomplish this, it is desirable to score, but not entirely cut, the drywall 1. This operation requires multiple scores, but removal of each segment defined between the scores is not possible due to necessity of maintaining integrity of the paper backing 9. Therefore, the guide 3 may not be repositioned on a newly cut edge 5, which would allow repeated cuts to be made without requiring measurement or adjustment of the knife position. The drywall craftsman would thus be obliged, in an arithmetic calculation, to add the width of each segment to the width of the previous measured interval, and adjust the prior art cutting tool 4 accordingly.

As the English system of measurement is widely adopted throughout the construction industry, most measurements are made in inches and fractions thereof. In an example, a series of 3 and $\frac{7}{8}$ inch strips are to be scored. With most prior art cutting tools 4, the craftsman must, in the present example, after each successive score, add two numbers each including a fraction, and adjust the cutting tool 4 to a new measurement determined by the sum arrived at by this awkward calculation.

With the novel tool 20, the stem 24 is adjusted relative to the guide 26 such that a measurement indicia mark 28A previously aligned with the guide 26 (FIG. 8A) is relocated to align with the last score line 10 (FIG. 8B). The guide 26 continues to rest against the original, uncut edge 5 of the drywall 1, and the knife 22A or 22B and stem 24 are adjusted for the new position. No measurement per se, nor calculation of measured quantities, is required to scribe a similar width one step lower on the drywall 1.

It is to be understood that the present invention is not limited to the embodiments described above, but encompasses any and all embodiments within the scope of the following claims.

I claim:

1. For selectively cutting and scoring a sheet of substantially planar material, a measuring and cutting tool comprising a longitudinal member having first and second ends, said longitudinal member defining a longitudinal axis of said cutting tool, said longitudinal member bearing graduated measuring indicia thereon and knife means attached to said longitudinal member first end, and guide means adjustably mounted on said longitudinal member, said guide means including a planar member disposed normal to said longitudinal axis, whereby said cutting tool is trued to the planar material by riding along an edge thereof, said guide means being selectively movable into and out of a deployed position, said guide means also including means selectively constraining said guide means against axial movement relative to said longitudinal member, wherein said guide means includes a handle with a passage for said longitudinal member so that moving the said handle towards the longitudinal member locks the guide means to said longitudinal member when in said deployed position and enabling said axial movement when out of said deployed position.

2. The measuring and cutting tool according to claim 1, further including means enabling said longitudinal member to rotate about said longitudinal axis with respect to said guide means, whereby said knife means is enabled to penetrate the planar material to a desired depth while cutting or scoring.

3. The measuring and cutting tool according to claim 1, said guide means further including manual locking means, whereby said guide means are manually secured to said longitudinal member, thus constraining said guide means from axial travel relative to said longitudinal member when locked.

4. The measuring and cutting tool according to claim 1, said knife means including removable fastening means attaching said knife means to said longitudinal member, and further including blade holding means, a removable cutting blade, and second handle means.

5. The measuring and cutting tool according to claim 1, said knife means further including means reversibly mountable on said longitudinal member, whereby right hand and left hand operation are selectively enabled.

6. The measuring and cutting tool according to claim 1, said graduated measuring indicia comprising a plurality of grooves formed in said longitudinal member.

7. The measuring and cutting tool according to claim 1, said knife means comprising a single, unitary part including integral blade means.

8. The measuring and cutting tool according to claim 1, said means selectively constraining said guide means against axial motion relative to said longitudinal member comprising means defining an opening, said opening having a diameter, said longitudinal member also having a diameter, said opening diameter being slightly greater than said longitudinal member diameter, whereby axial alignment of said longitudinal member within said opening enables relative axial motion between said longitudinal member and said guide means, and movement of said guide means into a position preventing axial alignment of said longitudinal member within said opening, and pressure urging said guide means into said position, cause friction axially immobilizing said longitudinal member and said guide means.

9. The measuring and cutting tool according to claim 1, said graduated measuring indicia comprising a linear, ascending scale wherein a zero value is located adjacent to said knife means, and higher numerical values progress in the direction of said longitudinal member second end.

10. The measuring and cutting tool according to claim 1, said guide means including means captively retaining said guide means on said longitudinal member and simultaneously enabling axial motion of said guide means along said longitudinal member when said guide means is moved out of a deployed position.

11. The measuring and cutting tool according to claim 1, said guide means having a first side facing said longitudinal member first end and a second side facing said longitudinal member second end, said longitudinal member having an actively employed portion measuring the planar material and supporting said knife means, and further being defined as extending between said guide means first side and said knife means, and an idle portion extending from said guide means second side toward said longitudinal member second end, whereby said longitudinal member actively employed portion projects from said guide means first side by a dimension equivalent to a length of said longitudinal member actively employed portion plus a thickness of said knife means, thus avoiding an interference between said longitudinal member and a floor of a drywall truck during cutting or scoring operations being performed on a narrow strip of planar material.

* * * * *